United States Patent [19]

Strauss

[11] 3,960,714

[45] June 1, 1976

[54] CENTRIFUGAL SEPARATOR WITH ROTARY DISTRIBUTOR

[75] Inventor: Werner Strauss, Bochum, Germany

[73] Assignee: Klockner-Humboldt-Deutz Aktiengesellschaft, Germany

[22] Filed: Dec. 23, 1974

[21] Appl. No.: 536,934

[30] Foreign Application Priority Data

Dec. 24, 1973 Germany ..... 2364568

[52] U.S. Cl. ..... 209/139 A; 209/148; 222/302

[51] Int. Cl.[2] ..... B07B 7/10

[58] Field of Search ..... 209/139 A, 139 R, 144, 209/148, 150; 222/302, 410, 293–295, 52; 214/17 CB, 18.38; 291/32; 241/225; 239/682, 687, 668

[56] References Cited

UNITED STATES PATENTS

| | | | |
|---|---|---|---|
| 667,573 | 2/1901 | Pfeiffer | 209/139 A |
| 1,346,015 | 7/1920 | Gibson et al. | 209/148 |
| 1,962,455 | 6/1934 | Montgomery | 209/139 A |
| 2,188,634 | 1/1940 | Sturtevant | 209/148 X |
| 2,206,981 | 7/1940 | Sturtevant | 209/139 A |
| 3,503,502 | 3/1970 | Donelson | 209/148 X |
| 3,677,703 | 7/1972 | Minnick | 209/139 A X |

FOREIGN PATENTS OR APPLICATIONS

| | | | |
|---|---|---|---|
| 582,358 | 12/1924 | France | 209/148 |
| 1,924,297 | 11/1970 | Germany | 209/139 R |

*Primary Examiner*—Frank W. Lutter
*Assistant Examiner*—Ralph J. Hill
*Attorney, Agent, or Firm*—Hill, Gross, Simpson, Van Santen, Steadman, Chiara & Simpson

[57] ABSTRACT

A centrifugal separator is provided with a rotary distributor provided with a plurality of vertically spaced coaxial rotating disks, in which the upper rotating disk is of smaller diameter than the lower rotating disk. The distance between the disks may be adjustable. The lower disk baffles an updraft separating air current whereby powdered material is separated from the coarser material as centrifuged from the upper disk, and any material escaping the upper disk without being thrown thereby into the air stream drops down on the larger lower disk and is thrown into the air stream by the lower disk. Either or both of the disks may be provided with agitator vanes.

15 Claims, 2 Drawing Figures

CENTRIFUGAL SEPARATOR WITH ROTARY DISTRIBUTOR

Figure 1:
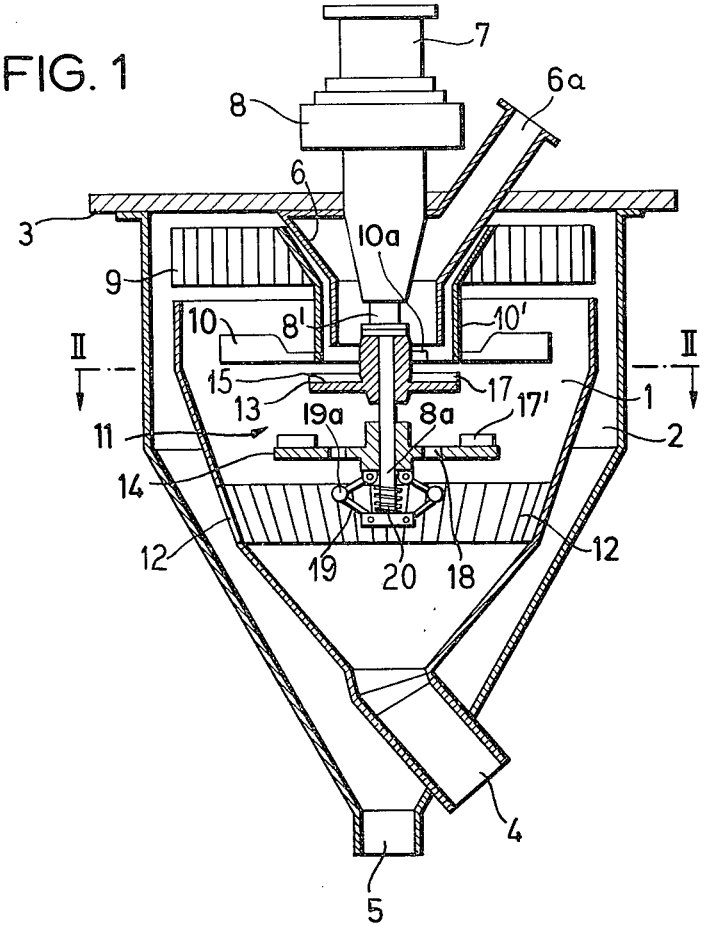

This invention relates to centrifugal separators, and is more particularly concerned with that type of separator which has rotary distributor means for the material to be separated.

The increasing demands on the mechanical conversion of granular to powdered material with the aid of centrifugal separators often requires adaptation of the various qualities of the material to be separated to the various purposes and fields of application of the material. This entails often frequent adaptation of the separators to the various qualities. For example, it may be necessary during any given operation to adapt the functioning of the separator to accommodate changes in size of the material to be separated.

In the type of centrifugal separators which employ an agitating disk, a fan wheel and a countervane system corotative on one shaft, a change in the character such as size of the granular material to be separated, requiring an adjustment of the blades of the countervane system, requires stopping of the separator and adjustment of the blades from the outside through openings into the separating chamber. Such separators cannot keep pace with the present-day high demands for preparatory treatment of such materials since the agitating disk employed is generally designed in such a way that at the lowest rotational speed the material is brought safely into the desired path of movement. However, any increase in the rotational speed deteriorates the flow path in such a way that the material strikes the wall of the separating chamber with such high speed impact that the material tends to adhere to the wall of the separating chamber and causes a change in the air flow so that separating efficiency is considerably impaired.

Heretofore it has been proposed to effect adjustments with respect to the efficiency of the final separating procedure in centrifugal separators in such a way that the countervane system is provided with a separate drive which is infinitely variable and the rotational direction of the countervane system is the same as the fan wheel and the agitating disk. In such an arrangement the countervane system is either driven by a miter gear inserted in the separating chamber or by a gear which is located below the fine-material discharge part of the separator, or by an adjustable electrical motor. With these prior complicated constructions, an air cooling means may have to be provided for the gears, requiring substantial amounts of air, and sometimes a forced lubrication with circulating cooling oil is necessary. Furthermore, in such a system where there are two separate rotating systems, the dust air mixture requires carefully designed bearing structures for the rotors in order to avoid substantial functional disturbances due to bearing damage. In addition, due to substantial abrasion wear and due to the fact that the dust-air mixture adheres to the walls, inbalances may occur at the rotating parts, placing even greater strain on the bearings.

It is therefore an important object of the present invention to provide a centrifugal separator which will avoid the disadvantages of prior separators and which in a simple and efficient constructional arrangement, provides for highly efficient separation of fine material from coarser material, even where the rotational speed of the fan structure may be changed, and independent of irregularities in the material input whether in the volume of material fed in or in regard to the quality of the material.

According to features of the invention, a centrifugal distributor is provided which has a plurality, preferably two, rotating disks which are arranged in superposed spaced relation coaxially, the upper disk having a smaller diameter than the lower disk. Thereby, should the fan speed be reduced, the material can drop down on the lower disk and be impelled by its centrifuging surface, the material thereby receiving increased centrifugal propulsion, thereby extending the effective encounter of the material to be separated with the separating air current and attaining improved separation. Because of this efficient two stage centrifugal capability not only is optimum agitation or centrifuging of the material attained, but also efficiency of separation is sustained even where the separating air current velocity may decrease below an optimum value.

The expensive and vulnerable prior structures employing independent fan-rotating disk control are avoided, while nevertheless achieving a separating efficiency which is every bit as effective as where independent control is effected. It is therefore possible to switch economically from one end product to another in the separating process. Variations in comminution of material to be separated and variations in the grinding qualities of the material can be compensated for possibly by increasing the volume of material. All of these advantages are attained according to the invention with low power consumption.

Adjustability of the distance between the centrifuging surfaces is provided for. For still better adaptation to variable qualities in the material to be separated, the centrifuging blades or vanes on the lower rotating disk can be structured to provide optimum agitating and centrifugal action without costly assembly changes.

According to features of the invention, the spacing and/or the diameter ratio of the rotating disks of the separator are so constructed that at the normal speed of operation the agitated or centrifuged material will not drop onto the lower rotating disk and therefore the efficiency of separation conforms to desired quality at the normal speed of the rotary distributor of the separator, the granular material traversing the paths of movement desired and a preferred thoroughness of separation maintained. The grain size of the material separated in operation of the separator maintains a satisfactory uniformity because the apparatus can be effectively operated at a proper centrifugal speed which will avoid excessive impact onto the wall of the separating chamber and thus undesired reduction in size of the particles breaking thereagainst or adhering to the wall and thus altering the air circulation pattern and interferring with separating efficiency.

Pursuant to the features of the invention at least one of the rotating disks provided on the rotating shaft of the apparatus is axially shiftable by means of a shifting device, thereby providing for optimum adaptation to various qualities of the material to be separated, carried out advantageously during operation by changing of the spacing between the agitating or centrifuging surfaces, or adjusting adaptively for quality of processing requirements on demand.

A particularly advantageous and efficient separating action is achieved by having at least one of the rotating disks provided with vanes on its centrifuging surface and during operation propelling the material to be separated into the rising annular air flow column in two superposed planes whereby an especially effective flushing of the fine or powdered material from the granules is effected by the air flow.

By providing the lowermost of the centrifuging disks with openings therein in the area thereof which is overhung by the upper of the rotating disks, improved centrifuging air circulation and weight reduction are attained.

Figure 2:
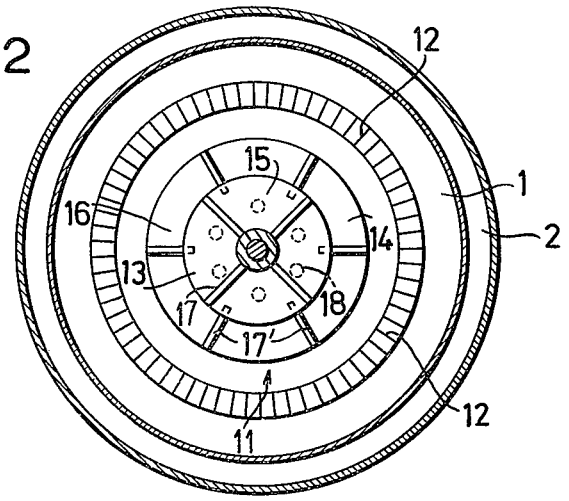

Other objects, features and advantages of the invention will be readily apparent from the following description of a preferred embodiment thereof, taken in conjunction with the accompanying drawings although variations and modifications may be effected without departing from the spirit and scope of the novel concepts embodied in the disclosure, and in which:

FIG. 1 is a schematic vertical sectional elevational view through a centrifugal separator equipped with a rotary distributor according to features of the invention; and FIG. 2 is a transverse sectional detail view taken substantially along the line II—II of FIG. 1.

In the exemplary embodiment in a centrifugal separator embodying features of the invention, as depicted in FIGS. 1 and 2, any suitable means provide a separating chamber 1 which flares upwardly from a relatively small diameter lower end to a relatively large diameter upper open end and is surrounded in spaced relation by means defining a fine material chamber 2 having its top above the top of the chamber 1 and closed by a top end closure plate 3. At its lower end, the separating chamber 1 has means defining a larger or heavier material discharge port 4 which exits through the lower end portion of the chamber 2. At the lower end of the generally funnel-shaped chamber 2 are means defining a fine material discharge port 5.

Concentric within the top of the chamber 2 and discharging downwardly concetrically within the upper end portion of the chamber 1 is a generally funnel-shaped inlet 6 into which material to be separated is delivered through an inlet charging port 6*a*. This structure is desirably carried by the inner side of the closure 3.

Also desirably carried by the closure 3 is an assembly comprising a driving motor 7 connected by means of a transmission gear unit 8 in driving relation to a rotary shaft 8′ extending downwardly concentrically through and being of substantially smaller diameter than the inside diameter of the discharge mouth of the inlet funnel 6. Also concentrically related to the chambers 1 and 2 and located at the shaft end of the chamber system are air circulation promoting means comprising conventional impeller means 9 located in clearance relation above and generally the same diameter as the upper end of the chamber 1, and a countervane device 10 of smaller diameter than the chamber 1 and located within the upper portion thereof adjacent to the discharge end of the inlet 6. Both the means 9 and the vane structure 10 are desirably carried by means of a tubular member 10′ concentric about the inlet 6 and which is suitably attached corotatively to the shaft 8′ as by means of a spider 10*a* Carried by the shaft 8′ below the discharge end of the inlet 6 and corotative with the shaft is a rotary distributor II. Adjacently below the distributor II and in a sloping annular area of the wall defining the chamber 1 is a uniformly spaced annular series of narrow slit air inlet openings 12 communicating from the fine material collecting chamber 2 with the separating chamber 1.

In a preferred arrangement, the rotary distributor II comprises two corotating, vertically spaced coaxial distributor disks 13 and 14, wherein the disk 13 is in the uppermost position adjacently below the inlet 6 and of somewhat larger diameter than the inlet discharge end but of about the same diameter as the lower end of the tubular member 10′ from which the disk 13 is adjacently spaced and which projects slightly below the discharge end of the inlet 6 to control positive deposit of material to be separated onto top surface 15 of the disk 13. The lower disk 14 is of substantially larger diameter than the upper disk 13, and the spacing and/or the diameter ratio of the corotating disks 13 and 14 is such that at normal speed of the device material dropped onto the upper disk 13 from the inlet 6 will not drop down onto an upper surface 16 on the lower disk 14 but will bypass the disk 14 within the separating chamber 1. On its upper surface 15, the upper disk 13 has radial impeller vanes 17, and on that portion of the lower disk 14 which is of larger diameter and projects radially beyond the disk 13 impeller vanes 17′ are provided on the upper surface 16.

Inwardly from the vanes 17′ and in the area of the disk 14 which is overhung by the upper disk 13, the disk 14 is provided with an annular series of holes 18 therethrough having the dual purpose of decreasing the weight of the disk 14 and permitting air to circulate upwardly through the disk 14.

In operation, comminuted material to be separated is charged into the centrifugal separator through the inlet charging port 6*a* and the inlet 6 onto the upper rotating disk 13 of the rotary distributor II driven by the motor 7, the material being centrifugally propelled from the disk 13 into the upper largest diameter portion of the separating chamber 1. Fines separating air which is circulated in updraft by action of the air impeller 9 separates from and draws off from the propelled material. The fines fraction and the heavier fraction of the separated material drops down within the separating chamber 1 and discharges through the port 4. Updraft generated by the impeller 9 passes up through the vanes 10 and the impeller 9 and then passes down within the chamber 2 to the discharge port 5. Air circulation is promoted by suction from the chamber 2 through the air inlet openings 12 into the separating chamber 1, whereby not only is updraft separating air column movement effective for separating the fine material from the coarse material, but also downdraft within the chamber 2 is promoted to accelerate dropping of the separated fines toward the discharge port 5.

Should the speed of rotation of the distributor 11 drop below a normal generally high speed centrifugal rate for any reason due to load or power fluctuations, and the like, or should the speed be reduced deliberately because of the character of the of the material to be separated, at least some of the material to be treated may drop down from the smaller diameter upper disk 13 by charge in its trajectory from generally straight horizontally laterally to a downwardly curved course onto the lower larger diameter disk 14, and more particularly the outer marginal area of the surface 16 thereof equipped with the impeller blades or vanes 17′. Any such material that drops down onto the disk 14 is propelled thereby laterally into the uprising air column or stream, and therefore thorough processing of the material to separate fines from the coarse material will be assured with utmost efficiency. Sometimes due to variations in the comminuted quality of the material being ground such as in a crusher prior to charging it into the separator, the material granules may be of a coarseness and weight which even at the normal speed of operation of the unit will take a downward trajectory from the upper disk 13 and thus drop onto the lower disk 14. For whatever reason the material may drop down onto the lower disk 14, irrespective of changes in rotary speed of the distributor 11, or irregularities in charging the separator, disturbing instabilities in the separating chamber 1 will be avoided so that substantially uniform separation efficiency is constantly maintained within the separator. It may be noted that not only is the centrifugal action of the lower disk 14 greater than the smaller diameter upper disk, with both disks rotated by the same shaft speed, but there is a larger number of the impeller vane blades 17' on the larger lower disk 14 than in impeller vane blades 17 on the smaller diameter upper disk 13. In addition, the air holes 18 in the lower disk 14 promote circulation of air up and over the lower disk 14 to enhance the propulsion of comminuted material from the disk 14 and accelerate separation of fines therefrom.

In order to increase the efficiency of the distributor 11, means such as a shifting device 19 conveniently in the form of a weighted toggle link centrifugal governor may be provided to control the spacing between the lower disk 14 and the upper disk 13. For example, the disk 13 may be mounted on the shaft 8' in fixed spaced relation adjacently below the charging means inlet 6 and the disk 14 may be vertically movable toward and away from the disk 13 by vertically slidable mounting of the disk 14 on a lower end portion 8*a* of the shaft 8'. The disk 14 may be maintained corotative with the shaft by means of the toggle links of the governor 19 which may be provided with biasing means such as a spring 20 to normally bias the lower disk 14 upwardly to a minimum preferred spacing below the upper disk 13 in opposition to toggle link weights 19*a* tending to shift the disk 14 downwardly. Thus, at relatively low rotary speeds the lower disk is maintained by the spring 20 closer to the upper disk and thus more quickly receives material dropping from the upper disk. At higher speeds of rotation, and particularly during normal high speed rotation, the centrifugal action of the toggle link weights 19*a* of the governor 19 cause contraction of the toggle links and displacement of the disk 14 downwardly to a greater spaced relation to the upper disk 13 whereby the lower disk efficiently receives material that may descend from the upper disk 13 but at a wider angle to the horizontal. Thereby automatic control for optimum efficiency is assured in the relative spacing between the upper and lower centrifuging distributor disks 13 and 14.

It will be understood that variations and modifications may be effected without departing from the spirit and scope of the novel concepts of this invention.

I claim as my invention:

1. A centrifugal separator including a separating chamber, means for charging material into the separating chamber, a rotary distributor in the chamber provided with coaxial rotating distributor disks one of which is smaller than the other of the disks and spaced thereabove, and means for rotatably driving the disks, said smaller disk being located adjacently below and at a fixed elevation relative to said charging means, and air circulation means for separating material in said chamber the improvement comprising:

means mounting the larger of the disks for vertical movement toward and away from said smaller disk; and means for effecting said vertical movements of the larger disk.

2. A centrifugal separator according to claim 1, wherein said means for effecting vertical movements are speed-responsive whereby to lower said larger disk at a normal rotary operating speed of the distributor, and to raise the larger disk toward the smaller disk at lower rotary speeds.

3. A centrifugal separator according to claim 1, wherein said means for effecting vertical movements includes an upward mechanical biasing device, and a centrifugally responsive device for overcoming the upward biasing device for lowering the larger disk.

4. A centrifugal separator according to claim 1, comprising a common rotary shaft mounting said disks, said larger disk being vertically slidably mounted on said shaft, and said means for effecting vertical movements providing a corotational coupling of the larger disk with the shaft.

5. A centrifugal separator according to claim 4, wherein said means for effecting vertical movements comprises a toggle link governor device.

6. A centrifugal separator according to claim 1, wherein said means for rotatably driving the disks comprising a shaft, and said air circulation means being corotatively carried by the shaft.

7. A centrifugal separator according to claim 6, wherein said larger disk has air circulation openings therein in the area thereof which is overhung by the smaller disk.

8. A centrifugal separator according to claim 1, including means in spaced relation around the separating chamber and providing a receiving chamber for fine material separated in the separating chamber, said means extending above the separating chamber and having a closure thereacross, the separating chamber opening upwardly in spaced relation below the closure, said means for charging material to be separated into the separating chamber comprising a charging inlet opening downwardly within the upper portion of the separating chamber and immediately below said closure, means encircling said inlet above said separating chamber and providing an air impeller for creating a separating updraft in the separating chamber and for driving the separated material into said receiving chamber, and said means for driving the disks comprising motor means and a shaft supported by said closure and with the shaft extending down through said inlet and supporting the disks concentrically below the inlet.

9. A centrifugal separator according to claim 8, including countervane means within the upper portion of said separating chamber between said air impeller and said rotary distributor, and means mounting said impeller and said countervane means corotatively on said shaft.

10. A centrifugal separator according to claim 8, wherein said shaft carries means for automatically speed responsively moving the larger disk under the smaller disk and thereby adjusting spacing of the larger disk under the smaller disk.

11. A centrifugal separator according to claim 8, wherein said separating chamber is defined by wall means tapering downwardly to a discharge outlet, and air circulation openings in said wall below said distributor for movement of air from said receiving chamber into said separating chamber past said larger disk.

12. A centrifugal separator according to claim 8, wherein said larger disk has air circulation openings therein in that portion of the larger disk which is overhung by said smaller disk.

13. A centrifugal separator according to claim 8, wherein said smaller disk has radially extending impeller vanes on its upper surface, and the larger disk has a substantial annular surface area which projects laterally beyond the diameter of the smaller disk and which area is provided with radially extending impeller blade vanes in greater number than the vanes on the smaller disk.

14. A method of centrifugal separation, comprising: charging material to be separated onto a first distributor disk within a separating chamber; rotating said first disk at a variable speed responsive to the load upon said first disk to thereby centrifugally propel the material to be separated into the separating chamber; rotating a larger diameter concentric second disk below said first disk at the same angular speed as said first disk to thereby centrifugally propel any material falling upon the second disk into the separating chamber; raising and lowering said second disk in response to decreases and increases, respectively, in said variable speed; and passing an updraft through the material propelled into the separating chamber by said disks to thereby separate said material into two fractions.

15. A method according to claim 14, including passing some of the updraft through opening means in said second disk and past said first disk.

* * * * *